US005551509A

United States Patent [19]

Braddick

[11] Patent Number: 5,551,509

[45] Date of Patent: Sep. 3, 1996

[54] WHIPSTOCK AND STARTER MILL

[75] Inventor: Britt O. Braddick, Houston, Tex.

[73] Assignee: TIW Corporation, Houston, Tex.

[21] Appl. No.: 409,879

[22] Filed: Mar. 24, 1995

[51] Int. Cl.[6] ..... E21B 7/08

[52] U.S. Cl. ..... 166/55.7; 166/117.5; 175/81

[58] Field of Search ..... 166/117.5, 117.6, 166/55.7; 175/81, 79, 82, 61, 73

[56] References Cited

U.S. PATENT DOCUMENTS

| | | | |
|---|---|---|---|
| 2,145,422 | 1/1939 | Kinzbach | 166/117.6 |
| 2,362,529 | 11/1944 | Barrett et al. | 166/117.6 |
| 2,766,010 | 10/1956 | Hester | 166/117.6 |
| 4,182,423 | 1/1980 | Ziebarth et al. | 166/117.5 X |
| 5,035,292 | 7/1991 | Bailey et al. | 175/45 |
| 5,383,522 | 1/1995 | Hailey | 166/117.5 X |
| 5,431,220 | 7/1995 | Lennon et al. | 166/117.6 X |
| 5,443,129 | 8/1995 | Bailey et al. | 175/45 |

OTHER PUBLICATIONS

TIW–Window Cutting Products and Services, Mar. 1994, 6 pp., advertising brochure.

The Red Baron Whipstock, 10 pp., advertising brochure.

Baker Packers–Model DW–1 Whipstock Anchor/Packer System, Apr. 1980, 1 p., advertising brochure.

A–1 Bowen whipstocks, 20 pp., advertising brochure.

"Dual horizontal extension drilled using retrievable whipstock", by Larry A. Cress and Stephen W. Miller, pp. 41, 42, 44, 46 & 48, World Oil/Jun. 1993, article.

*Primary Examiner*—Frank Tsay

*Attorney, Agent, or Firm*—Browning, Bushman, Anderson & Brookhart

[57] ABSTRACT

A mill kick out apparatus comprises a whipstock and a starter mill. The whipstock has a lower end pivotally connected to a supporting assembly, an upper end, an outer side for disposition adjacent one side of a well wall, and an inner side diametrically opposite the outer side. The outer side has a vertically elongate upper portion angularly disposed with respect to a lower portion thereof, whereby the upper portion may abut the one side of the well wall when the lower portion is inclined downwardly and inwardly with respect thereto. The inner side is configured to be disposed at a first downward and inward angle with respect to the one side of the well wall when the one side so abuts the upper portion of the outer side of the whipstock. A lug projects generally radially. inwardly from the inner side of the whipstock adjacent the upper end and has a generally radially inwardly facing surface disposed at a second downward and inward angle with respect to the one side of the well wall. The length of a primary portion of the lug surface is no greater than the length of the upper portion of the outer side of the whipstock. The starter mill is longitudinally movable with respect to the whipstock and comprises a rotary milling tool and a nose piece disposed below the milling tool. The nose piece has an upper portion of greater diameter than the distance between a lower part of the lug and another side of the well wall opposite the one side. The milling tool and the nose piece are relatively rotatable.

19 Claims, 3 Drawing Sheets

WHIPSTOCK AND STARTER MILL

BACKGROUND OF THE INVENTION

When an oil well has been drilled, or partially drilled, and cased, it is sometimes desired to open a window through the side of the casing to permit drilling of a deviated or side-tracked branch of the well disposed at a substantial angle with respect to the adjacent portion of the original wellbore.

A common way of so opening a window is to set a whipstock in the original wellbore. The whipstock has a generally concave radially inner side, face side, or trough which is angled or tapered downwardly and radially inwardly with respect to an adjacent side of the well wall, typically a casing wall. A starter mill apparatus, including an inwardly and downwardly tapered pilot portion below a milling portion, is lowered relative to the whipstock while also being rotated. The whipstock is furnished with a pilot lug near the top of its concave tapered inner side which engages the tapered pilot portion of the starter mill as it is lowered, directing and forcing the mill into the side wall of the casing facing the whipstock trough to effect penetration of the casing and facilitate cutting of the window. Thus, the starter mill forms a small lateral opening through the casing, or at least mills into the casing sufficiently to form a substantial upwardly facing shoulder in the casing. Then the starter mill apparatus is withdrawn and the milled part of the casing is elongated a window mill, which will form a sufficiently long window in the casing to serve as the upstream end of the side-tracked well branch when drilled therefrom in a manner well known in the art.

A common problem with known apparatus of this type is that the starter mill inevitably mills into the whipstock to a greater or lesser extent as well as the casing, thereby damaging the whipstock, possibly to the extent that it is thereafter impossible to mill a window. This problem results from the fact that it is difficult, if not impossible to determine precisely at what point the starter mill has milled a sufficient amount of the casing to permit the starter mill to be removed from the well and replaced with a window mill in order to complete milling of the window. Normally, milling is commenced with the starter mill and continued for a measurable downward distance which would be sufficient to mill the pilot lug from the whipstock and start the window. When milling with conventional coupled tubulars, such as drill pipe, at exceedingly great depths in a well, it is difficult to accurately measure the relatively short distances required to mill the pilot lug from the whipstock because of the elongation or stretch in the tubulars due to the tubulars' own weight. In the above instance, the degree of accuracy of measurement may range in feet rather than inches depending upon the depth of the operation. The problem of accuracy of measurement is significantly magnified when milling operations are conducted using downhole mud motors suspended from the bottom of coiled tubing strings. The degree of accuracy of measurement under the latter operations, can easily range between ten and twenty feet depending upon the depths of the operations.

The ability to start a window may be further exacerbated by rotational and longitudinal frictional wear to the starter mill pilot and/or the whipstock pilot lug. If the starter mill pilot becomes worn to a smaller outside diameter and/or if the height of the whipstock pilot lug is decreased due to wear as the respective items engage and co-relate with one another to effect the starting of the window, resulting or final dimensions of the respective items may be such, at the point of pilot lug mill-off, that the casing wall is not penetrated or a sufficient shoulder is not created in the casing wall to facilitate subsequent proper milling of the window with the window mill.

This problem is most prevalent in applications involving through-tubing window milling, where a smaller diameter tubular is positioned within the well above a larger size casing in which a window is to be milled. Since the outside diameters of the anchors, whipstocks, mills and other tools employed in milling the casing window must be of a size small enough to pass through the smaller tubular and operate to cause milling of a window in the larger casing, the starter mill must be equipped with milling blades having less depth and pilot noses having smaller diameters as well as whipstocks being furnished with thinner pilot lugs than are used on conventional full bore window milling operations. Thus, excess or slight wear, in some cases, cannot be tolerated without subsequent failure to start the window.

Another problem which exists with known apparatus, again with particular respect to through-tubing applications, stem from the lack of support of the back side (opposite the tapered concave face) of the whipstock by the adjacent casing wall. Since through-tubing whipstocks must be of a much smaller diameter than the casing in which they are set, they must be diagonally angled within the larger casing when set so as to position the top back-side against the inside of the casing opposite the side in which the window is to be milled while the bottom face-side is positioned against the casing adjacent the side in which the window is to be milled. Thus situated in an unsupported position along its full back-side by the casing, the whipstock is susceptible to flexing or bending when contacted by downward forces exerted upon it by the milling tools. Should this occur, flexing of the whipstock would result in the starter mill not being forced into the casing wall by contact of the starter mill pilot nose with the whipstock pilot lug.

With respect to full bore window milling applications, although state of the art whipstocks are equipped with hinges below the tapered concave troughs to enable the back side of the whipstock to lean against and contact the side of the casing opposite the window to be cut at their top ends, the angle between the back-side of the whipstock and the adjacent casing is so small and the unsupported standoff so slight, relative to the depth of the starter mill blades, that slight flexing of the whipstock does not usually effect successful starting of the window. The same is usually true with regard to wear of the window mill pilot nose and the whipstock pilot lug owing to the greater depth of the starter mill blades in full bore window milling operations.

SUMMARY OF THE INVENTION

The present invention involves several aspects, each of which can address one or more of the above problems independently, but which, in preferred embodiments, act in combination to provide particularly effective solutions.

In one aspect of the invention, the outer or back side of whipstock has a vertically elongated upper portion which is angularly disposed with respect to a lower portion thereof. Thus, the upper portion may abut the adjacent well wall side along its full length when the lower portion is inclined downwardly and inwardly with respect to that same well wall side, at least some such inclination being necessitated by the fact that the whipstock must be able to pivot with respect to the supporting assembly. In addition, a pilot lug in provided projecting generally radially inwardly from the inner side of the whipstock adjacent the upper end. This pilot lug has a generally radially inwardly facing lug surface which is disposed at a downward and inward angle with respect to the aforementioned side of the well wall. Furthermore, the vertical length of at least a primary portion of this lug surface is less than the vertical length of the upper portion of the outer or back side of the whipstock.

The relatively large bearing surface thus provided between the whipstock and the adjacent side of the well wall, after setting of the whipstock, serves to resist flexing of the whipstock when it has been engaged by the starter mill apparatus. Furthermore, because the pilot lug projects inwardly from the adjacent portion of the inner side or trough of the whipstock and provides an angular pilot mill surface, said pilot mill surface, upon engagement by the mill pilot, directs the mill away from said whipstock, allowing said mill to adequately mill the opposite side of the casing wall before it directly engages and begins to mill into the main body of the whipstock. The milling operation is enhanced or accelerated if the angle between the pilot mill surface and the well wall is greater than the angle between the whipstock trough and the well wall. Although the pilot lug itself will be at least partially milled away, the whipstock remains in proper form to guide a window mill after use of the starter mill.

The starter mill apparatus includes a nose piece disposed below the bit, mill cutter or milling blades, said nose piece being independently rotatable relative to the cutter or blades. The nose piece has an outside diameter at its upper and largest end that is greater than the distance between the lower part of the pilot lug and the side of the casing wall to be milled. Thus, after the mill apparatus has advanced a certain distance downwardly with respect to the whipstock, the nose piece will become lodged or wedged between the bottom of the pilot lug and the side of the casing in which the window is being milled, thereby preventing further downward movement of the milling apparatus. The dimensions are chosen so that this will only occur after the starter mill has milled a sufficient amount of the casing away, and has milled a portion of the pilot lug, but has not milled into the whipstock proper. Thus, this arrangement further prevents damage to the whipstock proper.

Additionally, when the starter mill nosepiece becomes lodged or wedged between the whipstock and the casing wall, no further downward movement of the starter mill occurs relative to the casing and whipstock, and since the cutter and its milling blades rotate independently relative to the starter mill nose piece, the cessation of downward movement of the starter mill results in no further milling of the casing wall and pilot lug. In addition, the bearing assembly of the starter mill pilot nose permits the starter mill blades or milling cutters to rotate, relatively free of friction, with respect to the lodged or wedged pilot nose. The above resultant actions cause a noticeable reduction in torque requirements to rotate the starter mill which are observable by a drilling operator at the surface of the well. With regard to conventional rotary drilling, the torque reduction is observable from state of the art instrumentation. With coiled tubing drilling applications employing a downhole fluid driven mud motor, torque reductions are observable by a reduction in the required fluid pressure to operate the motor. The noticeable occurrences of the above actions provide unmistakable signals to the drilling operator: that the starter mill has successfully completed its function of starting the window in the casing wall and removing a portion of the starter lug from the whipstock; and that the starter mill may be removed from the well and replaced with a window mill which will be run into the well to engage the milled shoulders in the casing wall and pilot lug of the whipstock to complete the milling of the window.

Various objects, features and advantages of the invention have been suggested by the foregoing, and others will be made apparent by the following detailed description, the drawings, and the claims.

DETAILED DESCRIPTION

Figure 1:
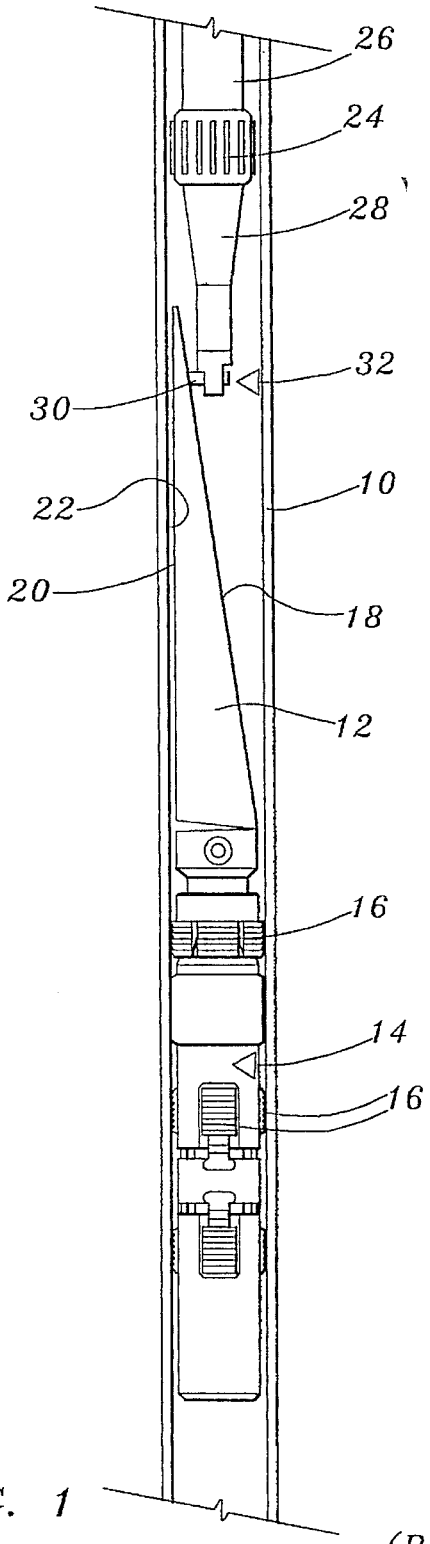
FIG. 1 is a side elevational view of prior art starter mill apparatus, whipstock and anchor in a first position.
Figure 2:
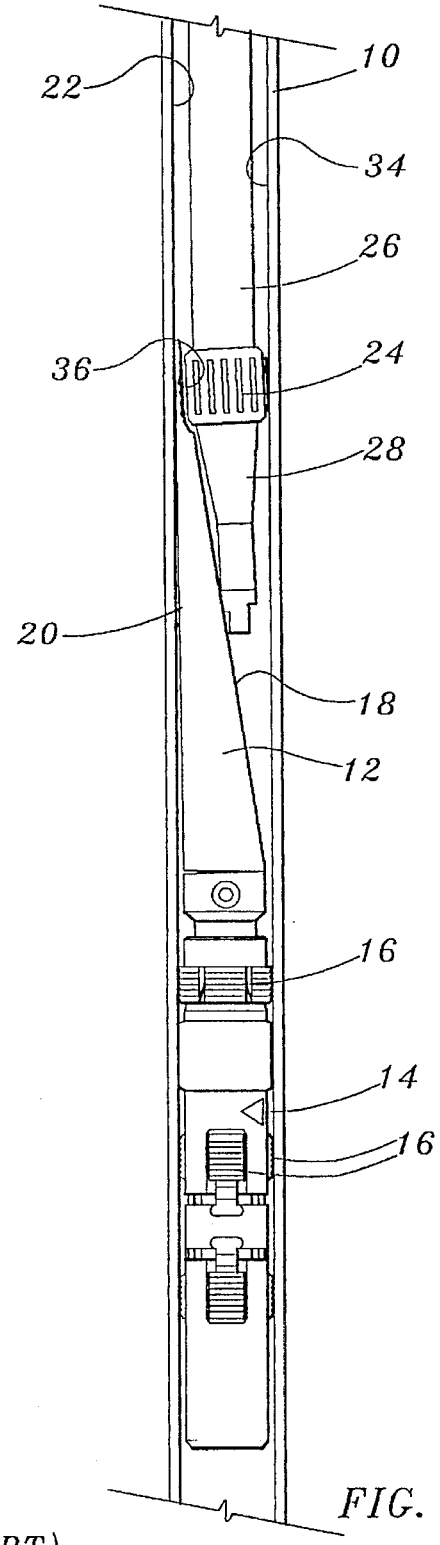
FIG. 2 (PRIOR ART)
FIG. 2 is a view similar to that of FIG. 1 showing the apparatus in a second position.

FIGS. 1 and 2 more specifically illustrate an example of a prior art apparatus of a type which can be improved by the present invention, as well as some of the problems associated with that art apparatus. The apparatus is illustrated as it would appear in a vertical well casing 10 for convenience, terms such as "upper", "lower" and "vertical" are used herein with reference to such typical orientation, and are not to be construed in a limiting sense.

The apparatus includes a whipstock 12 having its lower end pivotal connected to an anchor assembly 14 therebelow. The anchor assembly can be of any suitable type, as well known in the art, and will not be described in detail. It is merely noted that the anchor assembly 14 includes slips 16 which can be urged radially outwardly to grip the casing 10 and fix or anchor the assembly 14, both longitudinally and rotationally, with respect thereto. Slips 16 can be either permanently positioned or selectively retractable so that the whipstock and anchor assembly can be retrieved from the well.

The whipstock 12 has an inner side 18 an outer side 20. Inner side 18 defines a concave trough, deepest at its upper end and shallowest at its lower end, with a tapered width (see FIG. 5 which is similar, in this respect, to the prior art) varying from a wide upper end to relatively narrow lower end. As shown in FIG. 1, inner 18 and outer 20 sides converge, to a narrower upper end, from a relatively wide lower end. Sides 18 and 20 are arranged asymmetrically. More specifically, it can be seen that, when the apparatus is in the starting position of FIG. 1, the outer side 20 lies generally parallel to a closely adjacent side 22 of the well wall, which in this case is defined by the casing 10, whereas the inner or concave face 18 is disposed at a significant angle with respect to side 22.

The apparatus also includes a starter mill assembly including the cutter or bit proper 24, a connecting member 26 carrying the bit 24 and connecting it to a suitable work string (not shown) for rotating it, and a pilot or nose 28 depending downwardly from the bit 24.

Near its upper end, whipstock 12 has a small rectangular lug 30 welded or otherwise affixed near the top of its inner side 18 and projecting inwardly therefrom. Lug 30 is initially connected to the bottom of nose 28 by a shear pin arrangement 32, as is well known in the art.

After the whipstock 12 is set, a predetermined amount of tensile force applied to the workstring, from the surface of the well, breaks the shear pin, releasing the starter mill from the whipstock. The starter mill assembly 24, 26, 28 may then be rotated and moved downwardly with respect to the whipstock 12. As the nose 28 moves down, the whipstock is caused to pivot; specifically its upper end moves radially outwardly to a position shown in FIG. 2 wherein the upper end abuts the side 22 of the casing 10. In essence, only point contact is provided between outer side 20 and wall side 22, and that point contact is at the upper end of the whipstock 12, which is the thinnest part.

Lug 30 will direct the assembly 24, 26, 28 away from the whipstock 12 as the tapered nose engages the lug 30 and is lowered relative thereto. Lug 30 serves to continue to urge the starter mill assembly 24, 26, 28 closer and closer to the side 34 of the casing 10 diametrically opposite side 22. After starting of the window on side 34 of the casing 10 by inner-engagement of nose 28 with lug 30, the bit 24 begins to engage the lug 30. Continued downward milling will cause the lug 30 to be milled from the whipstock, and if such milling is not discontinued immediately thereafter, the bit 24 will continue to mill both casing and whipstock, as shown in FIG. 2, until the nose 28 wedges between the casing wall 10 and the troughed inner side 18 of the whipstock 12 causing a step 36 below said trough of the whipstock 12. The step 36 may thereafter be engaged by the window mill (which replaces the starter mill for continued milling of the window) and follow or track step 36 to mill into the body of the whipstock 12 rather than the casing 10. Further, because of the aforementioned point contact between surfaces 20 and 22, the whipstock 12 may flex under the downward force of the bit 24, exacerbating the extent to which the whipstock is damaged at step 36 by bit 24.

As FIGS. 1 and 2 show, these problems can occur even where the whipstock 12 is a full bore casing whipstock, i.e., a whipstock which can be run into a casing string which is free and clear of any substantial restrictions. In the case of through-tubing whipstocks, the aforementioned problems are exacerbated because, in order to enable the whipstock to pass through a tubing string set within the casing, the whipstock must be of a much smaller outside diameter than the inside diameter of the casing in which it is set, and it must be configured so that its outer or back side is disposed at a significant angle with respect to the adjacent side of the well wall after its setting within the casing.

Figure 3:
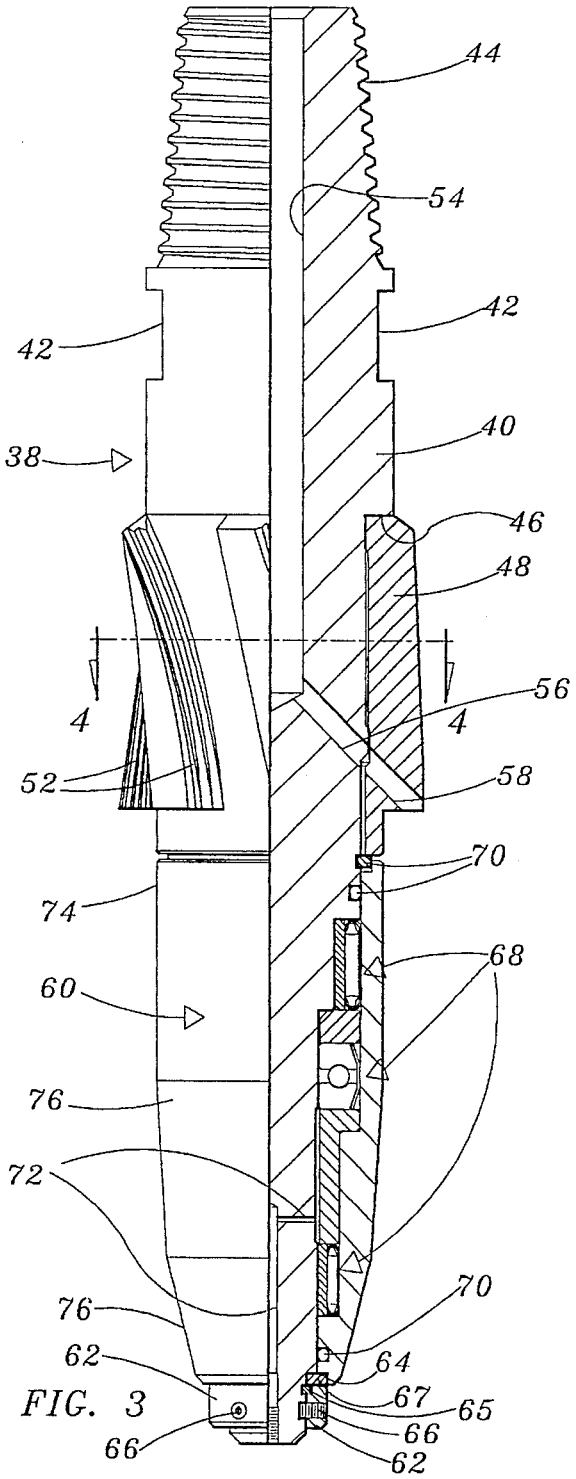
FIG. 3 is a longitudinal quarter-sectional view of a starter mill assembly according to the present invention.
Figure 4:
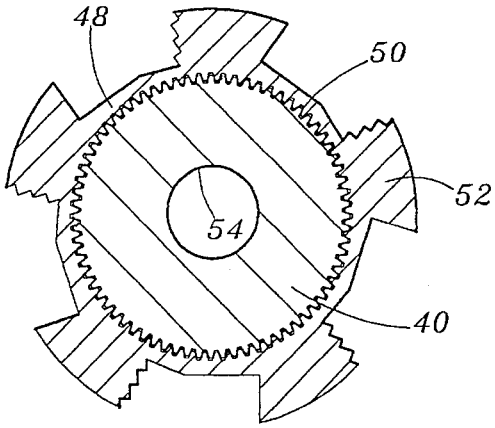
FIG. 4 is a transverse cross-sectional view taken along the line 4—4 of FIG. 3.

Turning now to FIGS. 3–7 there is shown an apparatus according to the present invention which addresses the above described problems. FIGS. 3 and 4 best show the details of the exemplary starter mill assembly 38. Assembly 38 comprises a central longitudinally extending mandrel 40, the upper part of which is exposed and defines make-up and break-out flats 42 and a pin connector 44 for making the assembly 38 up into a suitable workstring of a type well known in the art, and diagrammatically indicated at 46 in FIG. 6. More specifically, when coiled tubing 47 is employed as the workstring, the starter mill assembly 38 is connected to a downhole mud motor or other rotan motor 45 which imparts torque to the starter mill assembly 38 following the pressurized pumping of fluid through motor 45 and coiled tubing 47 extending upwardly therefrom.

Somewhat below the flats 42, the mandrel 40 has its diameter reduced to form a downwardly facing shoulder 46. The milling tool or bit 48 is emplaced in surrounding relation to this reduced diameter portion of the mandrel 40 with its upper end in abutment with shoulder 46, to prevent upper movement of the bit 48. As shown in FIG. 4, splines 50 interconnect the mandrel 40 and bit 48 to prevent relative rotation therebetween. The bit 48 includes a number of blades 52 which extend radially outwardly from a central annulus of the bit 48. Blades 52 also spiral longitudinally and circumferentially about the central annulus of bit 48 so as to maintain continuous blade contact with the concave face 88 (described below) of the whipstock 12 as the starter mill assembly 38 is rotated.

The upper portion of the mandrel 40 has a central bore 54 extending downwardly thereinto and terminating at an intersection with one or more smaller bores 56 extending angularly downwardly and radially outwardly through the mandrel 40, and each aligned with a similar angled bore 58 opening out through the bit 48 adjacent an outer lower edge thereof. A suitable fluid may be circulated through this system to cool the bit blades 52 and wash away debris, and it will be understood that splines 50 maintain proper alignment of matching pairs of bores 56 and 58.

The bit 48 is retained on the mandrel 40 in the longitudinal mode, i.e., prevented from falling downwardly off the mandrel, by a c-ring 111 in an annular groove in the mandrel 40 below the bit 48. A nose piece 60 is mounted in concentrically surrounding relation to the mandrel 40 below the bit 48 and is retained on said mandrel 40 by a keeper ring 65, positioned in an annular groove in the mandrel 40, opposing a downwardly facing thrust ring 67 near the lower end of the nose piece 60. Nose piece 60 is secured to the mandrel 40 by retainer ring 62 which is in turn secured to the mandrel 40 by screws 66 engaging screw sockets in the mandrel 40. Interposed between retainer ring 62 and shoulder 64 are two semi-annular keeper rings 65 and a thrust ring 67. The semi-annular keeper rings 65 relieve any downward force imposed on screws 66 by the nose piece 60.

Any suitable form of axial and thrust bearings may be interposed between mandrel 40 and nose piece 60 so that the nose piece 60 may rotate relative to mandrel 40, and thus relative to bit 48, unopposed by side and end loading as the mill assembly 38 is operated to start a window. As the precise form of bearings form no part of the invention per se, and those skilled in the art will understand how to provide suitable needle and roller bearings, bushings and/or combinations thereof, the exemplary bearings 68 shown in FIG. 3 will not be described in detail. It is noted, however, that the outer diameter of the mandrel 40 and the inner diameter of the nose piece 60 may be suitably stepped to fit and cooperate with the bearings, that seals 70 are provided above and below the bearing arrangements 68 and that passages 72 may be provided for lubricating the bearings 68.

Figure 6:
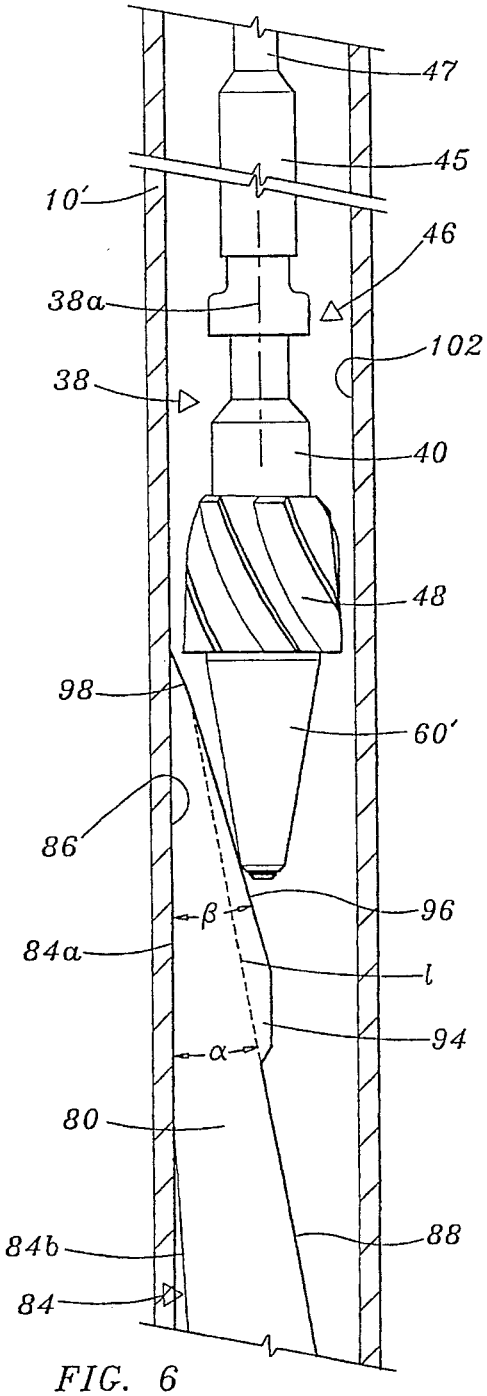
FIG. 6 is a side elevational view of the starter mill assembly and whipstock in use in a first position.
Figure 7:
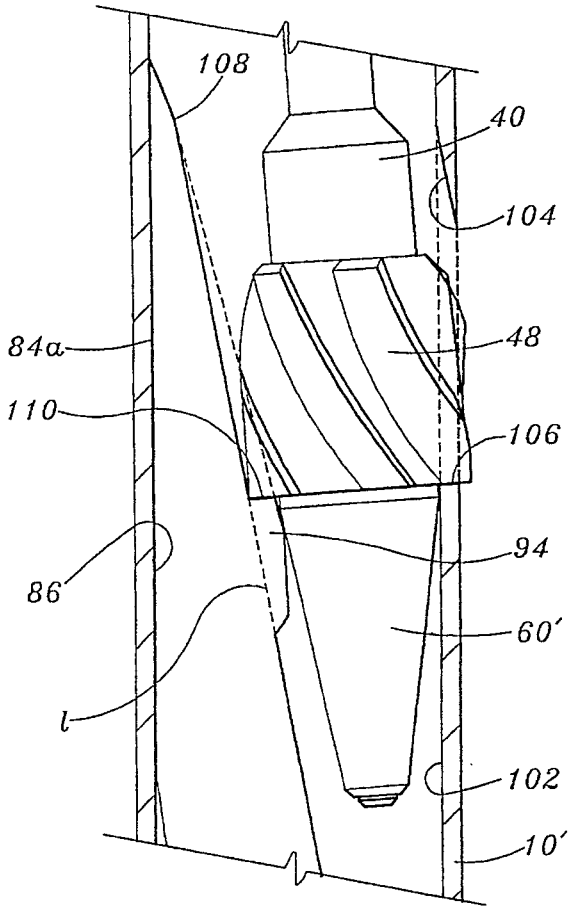
FIG. 7 is an enlarged detail view of the apparatus of FIG. 6 in a second position.

It is also noted that the outer surface of the nose piece is tapered downwardly and radially inwardly from its upper portion, which forms a juncture with bit 48, to its lower end. As shown in FIG. 3, the outer surface comprises a series of cylindrical 74 and frustoconical 76 sections which approximate the form of a paraboloid of rotation. As shown in FIGS. 6 and 7, the form is that of a single frustoconical member.

Figure 5:
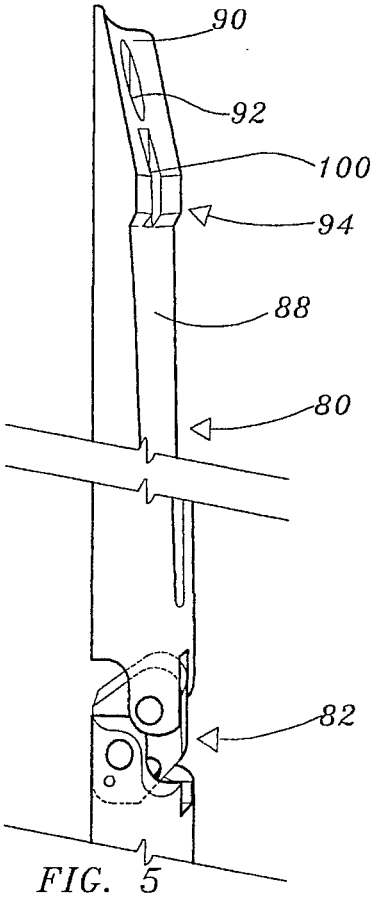
FIG. 5 is a perspective view of a through-tubing type whipstock in accord with the present invention.

Referring to FIGS. 5 and 6, a whipstock 80 according to the present invention is illustrated. Whipstock 80 is of the through-tubing type. A hinge assembly 82, mounted at the lower end of the whipstock 80 allows the whipstock to pass through a string of tubing (not shown) concentric with the casing 10'. Details of assembly 82 are disclosed in Assignee's copending application Ser. No. 08/409,276, filed Mar.

23, 1995, which is hereby incorporated by reference for all purposes. As best seen in FIG. 6, the outer or back side 84 of the whipstock 80 is not straight. Rather, there is a large obtuse angle between an upper portion 84*a* of the side 84 and a lower portion 84*b*. Thus, when whipstock 80 is properly positioned and set within the well, the entire upper portion 84*a* of the outer or back side 84 can abut the adjacent side 86 of the casing 10', providing a long bearing surface, while the lower portion 84*b* is disposed at a significant angle to side 86. This helps to prevent or avoid flexing of the whipstock 80 once it is engaged by the starter mill assembly 38 during window starter operations.

The upper end of the whipstock 80 is pointed, and the inner or face side 88 is inclined downwardly and radially inwardly therefrom at a first angle $\alpha$ with respect to the adjacent wall side 86 of the casing 10'. As shown in FIG. 5, adjacent the upper end, inner side 88 is also concavely curved or troughed in a circumferential sense, as indicated at 90. Extending downwardly into the upper end of whipstock 80 is a running and retrieving port 92 (the embodiment shown is a retrievable through-tubing whipstock), which may be of any type well known in the art, and is therefore not described in detail. Those skilled in the art will appreciate that the central axis 38*a* of the starter mill assembly 38 would normally be generally parallel with the sides of the casing 10' when the starter mill first engages the whipstock 80 as shown in FIG. 6.

A pilot lug 94 disposed on inner or face side 88, adjacent the upper end of the whipstock 80, and just below the port 92, projects radially inwardly from the main profile $\iota$ of face side 88. The uppermost part of lug 94 is inclined downwardly and radially inwardly at a second angle $\beta$ with respect to wall 86. This inclined portion 96 serves as a surface to direct the starter mill, in a manner to be described more fully below, and the inclination of the inner or face side 88 along the upper end may form an extension of the surface 96, as indicated at 98. Pilot lug 94 also has a vertically elongated slot 100 extending radially thereinto. In the embodiment shown, lug 94 is formed monolithically with the whipstock 80. A line $\iota$ forming an upward continuation of the face side 88 below the lug 94, i.e., at the same angle $\alpha$ with respect to the wall 86, may be considered the juncture line between the pilot lug 94 and the whipstock 80, for purposes of the present discussion.

FIGS. 6 and 7 show part of the whipstock 80, properly emplaced or set within the casing 10', and the way it cooperates with a starter mill assembly 40, 48 and 60', according to the present invention. Assembly 40, 48 and 60' may be presumed to be virtually identical to the assembly 38 shown in FIGS. 3 and 4, except that the outer surface of the nose piece 60' has a single, continuous, frustoconical configuration.

As the assembly 40, 48, 60' is run into the well, and moves downwardly with respect to the whipstock 80, the tapered nose piece 60' will eventually engage the pilot lug surface 96(note that running and retrieving port is 92 sized such that tapered nose piece 60' of starter mill assembly will not engage or enter the port), or depending upon the design of the apparatus, its extension 98, which will begin to urge the assembly 40,48, 60' toward the sidewall 102 of casing 10'. Preferably, the dimensions and configurations of the nose piece 60', the bit 48, the pilot lug 94, and the casing 10' are related such that the bit 48 will begin to engage and commence milling the side 102 of casing 10' at least before it can engage the part of the whipstock 80 disposed above pilot lug 94, and preferably before it begin to engage the pilot lug surface 96.

In any event, these configurations and relative dimensions are such that, as milling progresses, the large upper end of the conical nose piece 60' will lodge or wedge between the lower part of the pilot lug 94 and the side 102 of casing 10', as shown in FIG. 7, thereby preventing further downward movement of the bit 48 before bit 48 has drilled inwardly past lug 94, i.e., past line $\iota$, into the body of the whipstock proper, but after the bit 48 has started an opening 104 in the side 102 of casing 10'. This is facilitated where, as shown, $\beta>\alpha$. Although, in FIG. 7, the bit 48 is shown having completely penetrated (at 104) wall 102 of casing 10', it may sometimes be adequate that the bit simply form a substantial shoulder 106 in casing side 102, even if the casing is not penetrated.

It is noted that bit 48 does mill away part of pilot lug 94, beginning at a point 108. The portion of pilot lug surface 96 from point 108 downward will be referred to herein as the primary portion of the pilot lug surface in that it is the portion which is actually engaged forcefully by nose piece 60' and the bit 48. In accord with the present invention, it is preferred that the upper portion 84*a* of the outer side 84 of the whipstock 80 at least be approximately as long as the primary portion of the pilot lug surface 96, including its extension 98. It is also noted that milling to the point shown in FIG. 7, by milling away part of the lug 94, will form an upwardly facing shoulder 110 thereon.

As the nose piece 60' first begins to engage the whipstock 80, the concave curvature 90 of the upper end of the whipstock helps to position the nose piece 60' with respect thereto, and this function is continued by the slot 100, which also reduces the amount of material to be milled from the pilot lug 94, thereby decreasing wear on the bit 48. Frictional wear between the nose piece 60' and the pilot lug surface 96 is negated by the fact that the nose piece 60' is rotatable relative to bit 48, so that it need not rotate against surface 96 of lug 94, even though the bit 48 is rotating, and its engagement with the edges of the slot 100 help to keep the bit 48 centered with the face 88 of the whipstock 80.

When the milling has progressed to the point indicated in FIG. 7, such that no further downward movement can be achieved, the operator will observe a distinct reduction in torque requirements to the starter assembly 40, 48, 60'. This reduction in torque requirements will be particularly dramatic in the preferred embodiment wherein nose piece 60' and bit 48 are relatively rotatable, because as bit 48 continues to rotate, nose piece 60' will not impart rotational or longitudinal frictional drag along the surfaces between which it is lodged or wedged. Additionally, as the nose piece 60' becomes lodged or wedged between pilot lug 94 and the casing, the cessation of downward motion of the starter mill assembly 40, 48,60' results in a reduction in torque requirements to the starter mill assembly, since the bit 48 is no longer milling either the casing shoulder 106 nor the pilot lug surface 96, or the pilot lug shoulder at 110. As previously mentioned, this reduction in torque requirements is observable from state of the art instrumentation for conventional rotary drilling applications, whereas in through-tubing applications, the reduction in torque requirements is observable from a reduction in applied fluid pressure required to power downhole mud motors as shown at 46 in FIG. 4. Thus the pressure drop serves as a signal to the operator that an adequate starting cut for a window has been milled, and the starter mill assembly 40, 48, 60' can be withdrawn from the well. Next a window mill, not a part of the invention, can be run into the well, and when engaged with shoulders 110 and 106, will continue milling to remove the remainder of pilot lug 94 and follow the concave surface or face 88 of the whipstock 80 to lengthen the window 104 thus started in the casing wall 10'.

Many modifications of the embodiments described above will suggest themselves to those skilled in the art. Accordingly, it is intended that the scope of the invention be limited only by the following claims.

What is claimed is:

1. A mill kick out apparatus comprising:

a whipstock having a lower end pivotally connected to a supporting assembly;

an upper end;

an outer side for disposition adjacent one side of a well wall and having a vertically elongate upper portion angularly disposed with respect to a lower portion thereof, whereby the upper portion of the outer side may abut the one side of the well wall when the lower portion is inclined with respect to the upper portion and is radially spaced from said one side of the well wall;

an inner side diametrically opposite the outer side and configured to be disposed at a first angle with respect to the one side of the well wall when the upper portion of the outer side of the whipstock abuts the one side of the well wall; and a lug projecting generally radially inwardly from the inner side of the upper end of the whipstock and having a facing surface disposed at a second angle inclined with respect to both the first angle and with respect to the one side of the well wall, an axial length of the facing surface being no greater than an axial length of the upper portion of the outer side of the whipstock.

2. The apparatus of claim 1, wherein the second angle is greater than the first angle.

3. The apparatus of claim 1, wherein the upper end of the whipstock above the lug includes an upper surface angled to form a continuation of the facing surface.

4. The apparatus of claim 3, wherein the combined axial length of the upper surface on the upper end of the whipstock and the facing surface is less than the axial length of the upper portion of the outer side of the whipstock.

5. The apparatus of claim 1, wherein the lug has a vertically elongated channel recessed radially thereinto.

6. The apparatus of claim 1, wherein the whipstock is of the through-tubing type.

7. The apparatus of claim 1, further comprising:

starter mill apparatus having a central axis and longitudinally movable with respect to the whipstock and engageable with the facing surface, the starter mill apparatus including a rotary milling tool and a nose piece disposed below the milling tool.

8. The apparatus of claim 7, wherein the nose piece is tapered radially inwardly toward the central axis from the juncture with the milling tool.

9. The apparatus of claim 8, wherein the nose piece has an upper portion of greater diameter than the distance between a lower portion of the facing surface and another side of the well wall opposite the one side.

10. The apparatus of claim 9 comprising a rotary motor operatively connected to the milling tool and a length of coil tubing extending upwardly from the motor.

11. The apparatus of claim 7, wherein the nose piece has an upper portion of greater diameter than the distance between a lower portion of the facing surface and another side of the well wall opposite the one side.

12. The apparatus of claim 11, wherein the milling tool and the nose piece are relatively rotatable.

13. The apparatus of claim 7, wherein the milling tool and the nose piece are relatively rotatable.

14. A mill kick out apparatus comprising:

a whipstock having a lower end pivotally connected to a supporting assembly;

an upper end;

an outer side for disposition adjacent one side of the well wall;

an inner side diametrically opposite the outer side and having a face surface adjacent the upper end disposed at a downward and inward angle with respect to the one side of the well wall; and starter mill apparatus longitudinally movable with respect to the whipstock and comprising a rotary milling tool and a nose piece disposed below and rotatable independently of the milling tool, the nose piece having an upper portion of greater diameter than the distance between a lower end of the face surface and another side of the well wall opposite the one side.

15. The apparatus of claim 14, wherein the nose piece is tapered from a juncture with the milling tool.

16. The apparatus of claim 15 further comprising:

a rotary motor operatively connected to the milling tool and a length of coil tubing extending upwardly from the motor.

17. The apparatus of claim 16, wherein the milling tool and the nose piece are relatively rotatable.

18. A starter mill apparatus for milling laterally into one side of a well casing, comprising:

a rotary milling tool and a nose piece disposed below the milling tool, the milling tool and the nose piece being relatively rotatable.

19. The apparatus of claim 18, wherein the nose piece is tapered from the juncture with the milling tool.

* * * * *